US006606932B2

(12) United States Patent
Goldstein

(10) Patent No.: US 6,606,932 B2
(45) Date of Patent: Aug. 19, 2003

(54) METHOD AND APPARATUS FOR NEUTRALIZATION OF MINES AND OBSTACLES

(75) Inventor: Yeshayahu S. Goldstein, Gaithersburg, MD (US)

(73) Assignee: APTI, Inc., Washington, DC (US)

( * ) Notice: Subject to any disclaimer, the term of this patent is extended or adjusted under 35 U.S.C. 154(b) by 0 days.

(21) Appl. No.: 10/005,540

(22) Filed: Nov. 26, 2001

(65) Prior Publication Data

US 2002/0121210 A1 Sep. 5, 2002

Related U.S. Application Data

(63) Continuation of application No. 09/511,679, filed on Feb. 23, 2000, now Pat. No. 6,324,956.

(51) Int. Cl.[7] ..... F41F 5/00; B63G 9/00

(52) U.S. Cl. ..... 89/1.13; 102/402; 102/403; 367/145

(58) Field of Search ..... 89/1.13; 102/402, 102/103; 367/145

(56) References Cited

U.S. PATENT DOCUMENTS

| | | | | |
|---|---|---|---|---|
| 2,994,268 A | | 8/1961 | Watson | 102/7 |
| 3,012,534 A | | 12/1961 | Thomas | 114/235 |
| 4,188,905 A | | 2/1980 | Weller et al. | 114/253 |
| 4,656,948 A | | 4/1987 | Tsukiuda et al. | 102/452 |
| 4,697,522 A | | 10/1987 | Groschupp et al. | 102/402 |
| 4,969,399 A | | 11/1990 | Kish | 102/402 |
| 5,072,647 A | * | 12/1991 | Goldstein et al. | 89/8 |
| 5,844,159 A | | 12/1998 | Posseme et al. | 89/1.13 |
| 5,859,383 A | | 1/1999 | Davison et al. | 102/307 |
| 5,864,517 A | | 1/1999 | Hinkey et al. | 367/145 |
| 6,032,567 A | | 3/2000 | Jones et al. | 89/1.13 |
| 6,142,056 A | | 11/2000 | Taleyarkhan | 89/7 |
| 6,152,010 A | * | 11/2000 | Mixon et al. | 89/1.13 |
| 6,324,956 B1 | * | 12/2001 | Goldstein | 89/1.13 |
| 6,408,614 B1 | * | 6/2002 | Eizenhofer | 60/200.1 |

* cited by examiner

*Primary Examiner*—Charles T. Jordan
*Assistant Examiner*—John W. Zerr
(74) *Attorney, Agent, or Firm*—Rossi & Associates

(57) ABSTRACT

The invention provides a method and apparatus for neutralizing mines and obstacles that can quickly and efficiently clear a specified surf zone without human intervention. In a preferred embodiment, the invention utilizes firing tubes including a combustion chamber, a mechanism for supplying an aluminum fuel to the combustion chamber; and an ignitor for igniting the aluminum fuel within said combustion chamber to generate pressure waves. The firing tubes arranged in arrays located on sides of a main body of an autonomous vehicle. Activation of the firing tubes on a rear side of the main body is utilized in a preferred embodiment to propel the vehicle forward. Forward propagating pressure waves generated by firing tubes arranged on forward facing first and second sides of the main body are utilized to destroy mines and other obstructions located within a selected surf area.

4 Claims, 6 Drawing Sheets

METHOD AND APPARATUS FOR NEUTRALIZATION OF MINES AND OBSTACLES

This is a continuation of application Ser. No. 09/511,679 filed Feb. 23, 2000, now U.S. Pat. No. 6,324,956.

FIELD OF THE INVENTION

The present invention relates in general to methods and apparatus for clearing water mines and obstacles located under water from a specified surf zone or area. More specifically, the invention is related to a method and apparatus for neutralization of mines and obstacles that utilizes high pressure pulses to destroy mines and obstacles within the surf zone.

BACKGROUND OF THE INVENTION

The neutralization of mines and obstacles from within a specified surf zone or harbor is a crucial function in assuring success of military landing operations during periods of conflict. It is equally important to clear mines and obstacles from a specified surf zone or harbor after the end of hostilities to allow a return to normal use of such areas. The most effective conventional method of removing mines and obstacles in relatively shallow surf areas still relies on individuals to attach explosive charges to the mines and obstacles and the activation of those explosive charges in order to clear a path through the surf area. This method is time consuming and extremely dangerous to the individuals involved in placing the explosive charges. It would therefore be beneficial to provide a method and apparatus for neutralizing mines and obstacles that could quickly and efficiently clear a specified surf zone without human intervention.

SUMMARY OF THE INVENTION

It is an object of the invention to provide a method and apparatus for neutralizing mines and obstacles that can quickly and efficiently clear a specified surf zone without human intervention. In a preferred embodiment, the invention utilizes firing tubes including a combustion chamber, a mechanism for supplying an aluminum fuel to the combustion chamber; and an ignitor for igniting the aluminum fuel within said combustion chamber to generate pressure waves. The firing tubes arranged in arrays located on sides of a main body of an autonomous vehicle. Activation of the firing tubes on a rear side of the main body is utilized in a preferred embodiment to propel the vehicle forward. Forward propagating pressure waves generated by firing tubes arranged on forward facing first and second sides of the main body are utilized to destroy mines and other obstructions located within a selected surf area.

Alternatively, the firing tubes can be located on a main body of a ship to generate pressure waves to destroy torpedoes or other projectiles targeted at the ship. Still further, the firing tubes can be utilized to generate pressure waves for sonar devices such as sonar buoys.

Still further advantages, features and embodiments will become apparent from the following detailed description of the preferred embodiments and accompanying drawings.

BRIEF DESCRIPTION OF THE DRAWINGS

The invention will be described in detail with reference to certain preferred embodiments thereof and the accompanying drawings, wherein.

DETAILED DESCRIPTION OF THE PREFERRED EMBODIMENTS

Figure 1:
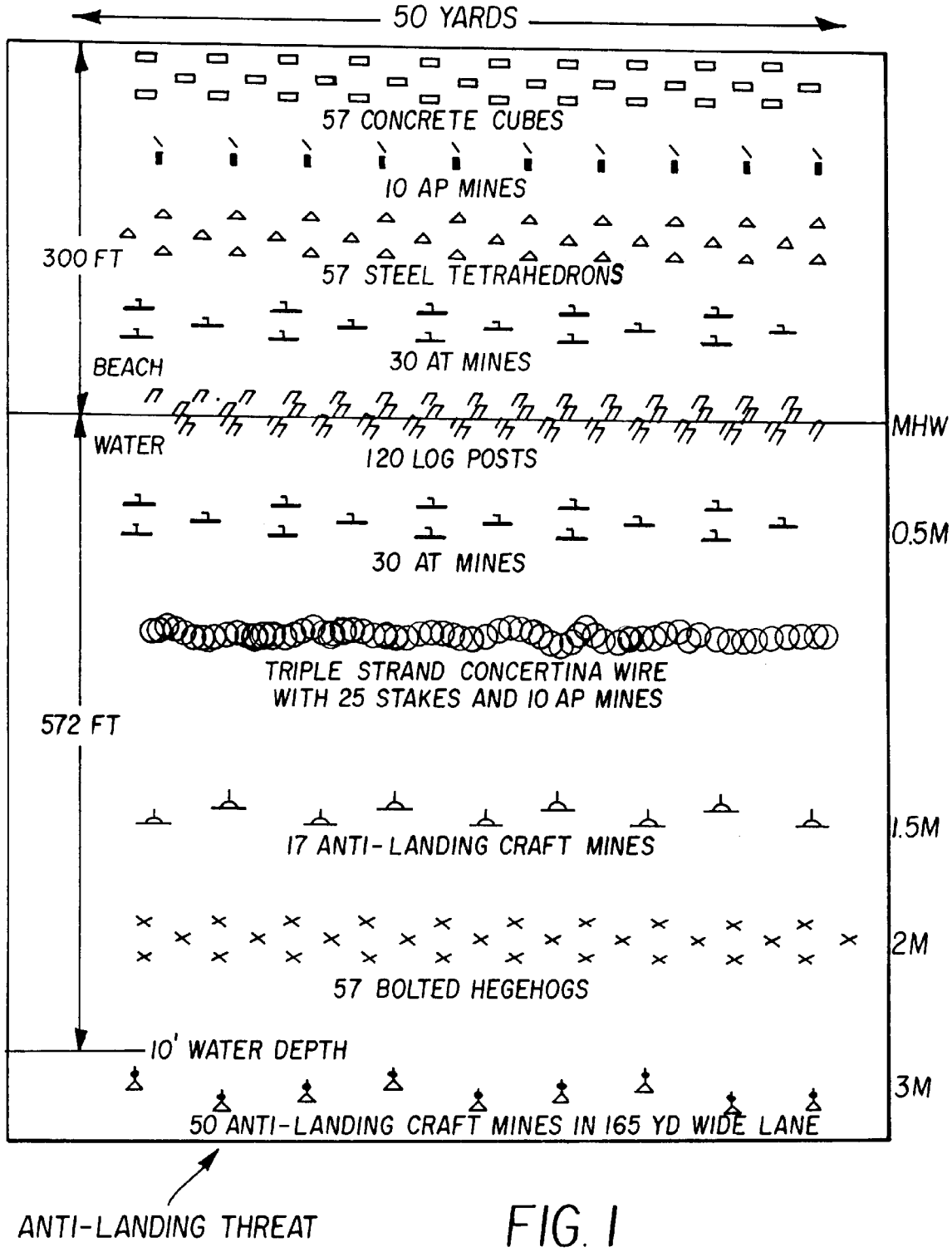
FIG. 1 illustrates a surf area and an accompanying beachhead incorporating a number of mines and obstacles that present an anti-landing threat.

FIG. 1 illustrates a surf area and an accompanying beachhead incorporating a number of mines and obstacles that present an anti-landing threat. The mines and obstacles include anti-landing craft mines, bolted hedgehogs, concertina wire and log posts. In order to successfully complete a landing operation, it is necessary to clear a path through the surf area to allow landing craft to reach the accompanying beachhead. The neutralization of the mines and obstacles in the surf zone can be achieved by high pressure impulses in the water, such as those generated by explosives detonated under water. Instead of relying on saturation bombing of the surf area or the use of individuals to attached explosives to the obstacles, the present invention provides an unmanned undersea vehicle with a mechanism for generating the required pressure pulses.

Figure 2:
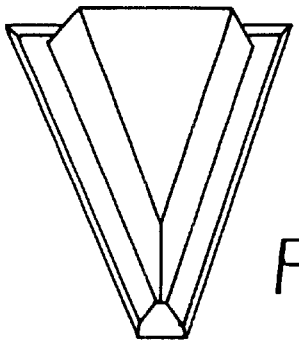
FIG. 2 illustrates a top view of an apparatus in accordance with the invention.
Figure 3:
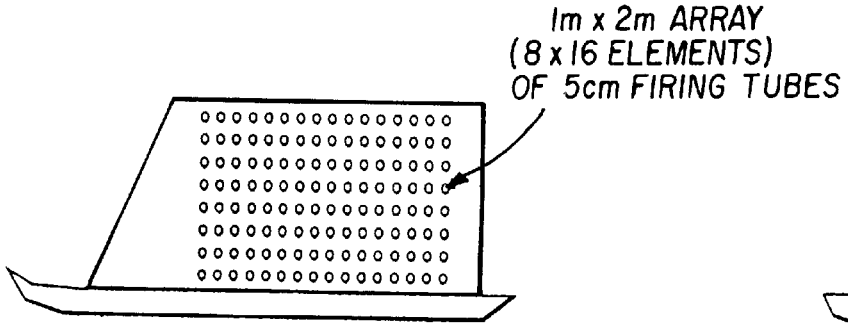
FIG. 3 illustrates a side view of the apparatus illustrated in FIG. 2.
Figure 4:
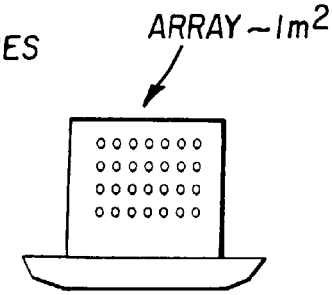
FIG. 4 illustrates a rear view of the apparatus illustrated in FIG. 2

An unmanned undersea vehicle in accordance with the invention is illustrated in FIGS. 2–4 as including a wedge type main body located on a sled-like base. The wedge type main body includes a first side, a second side and a rear side, each of which includes an array of firing tubes. The firing tubes are capable of generating multiple shots that generate pressure waves which propagate from the main body and through the surrounding water. The total effect of these pressure waves is preferably equivalent to approximately one kiloton of high explosives. In operation, the vehicle is preferably moved forward by activating the array located on the rear side of the main body to generate multiple rearward propagating pressure waves. The force of the rearward propagating pressure wave pushes the vehicle forward approximately one meter at a time. After each movement, the arrays on the first and second sides of the main body are activated to generate forward propagating pressure waves that propagate through the water and impact on the mines and obstacles contained therein. In order to maintain the position of the vehicle, the array on the rear side of the main body is also preferably activated upon activation of the arrays on the first and second sides of the main body to counteract the force of the forward propagating pressure waves. Although the use of the array on the rear side for propulsion is preferred, it will be understood that other conventional forms of propulsion including driven tracks or wheels can be utilized to propel the main body forward.

Figure 5:
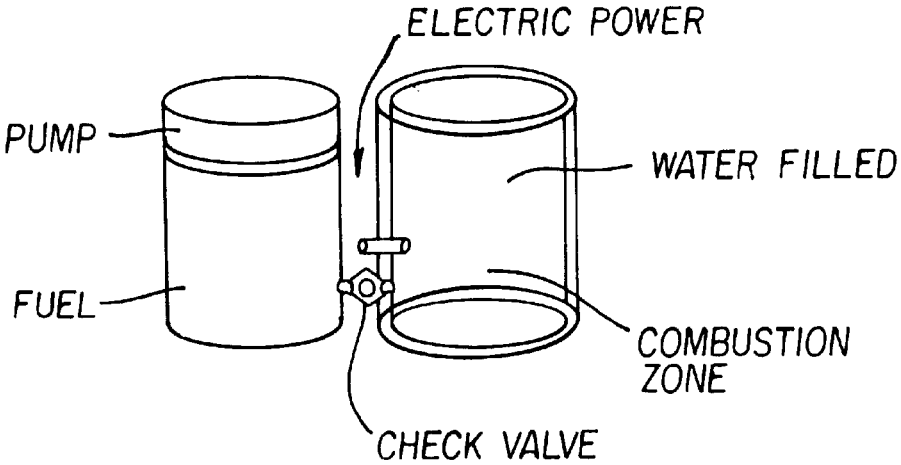
FIG. 5 illustrates a basic schematic diagram of a firing tube utilized in the apparatus of FIG. 2.

A basic schematic diagram of a firing tube is illustrated in FIG. 5. The firing tube includes a combustion chamber that is coupled to a fuel chamber by a check valve. A pump is provided to pump fuel from the fuel chamber into the combustion chamber via the check valve. The check valve is then closed and an electrical pulse is supplied to an ignitor that generates a spark within the combustion chamber thereby causing the fuel provided within the combustion chamber to burn.

In the preferred embodiment, the firing tube utilizes aluminum powder as a fuel that is mixed with sea water which enters the aperture of the firing tube. Aluminum powder generates chemical energy via the following equation when burned:

$$2Al+3H_2O>Al_2O_3+3H_2+820\ kJ \qquad \text{(Eq. 1)}$$

Accordingly, every gram of aluminum generates about 15.2 kJ, or about four times as much as TNT for the same weight. The mix of aluminum powder and water bums instead of exploding, and can therefore be used to generate prolonged pulses (on the order of hundreds of microseconds to milliseconds) of medium pressure (e.g. 30 kpsi.) The firing tubes can also be repeatedly fired without detriment under control of a control processing unit.

Figure 6:
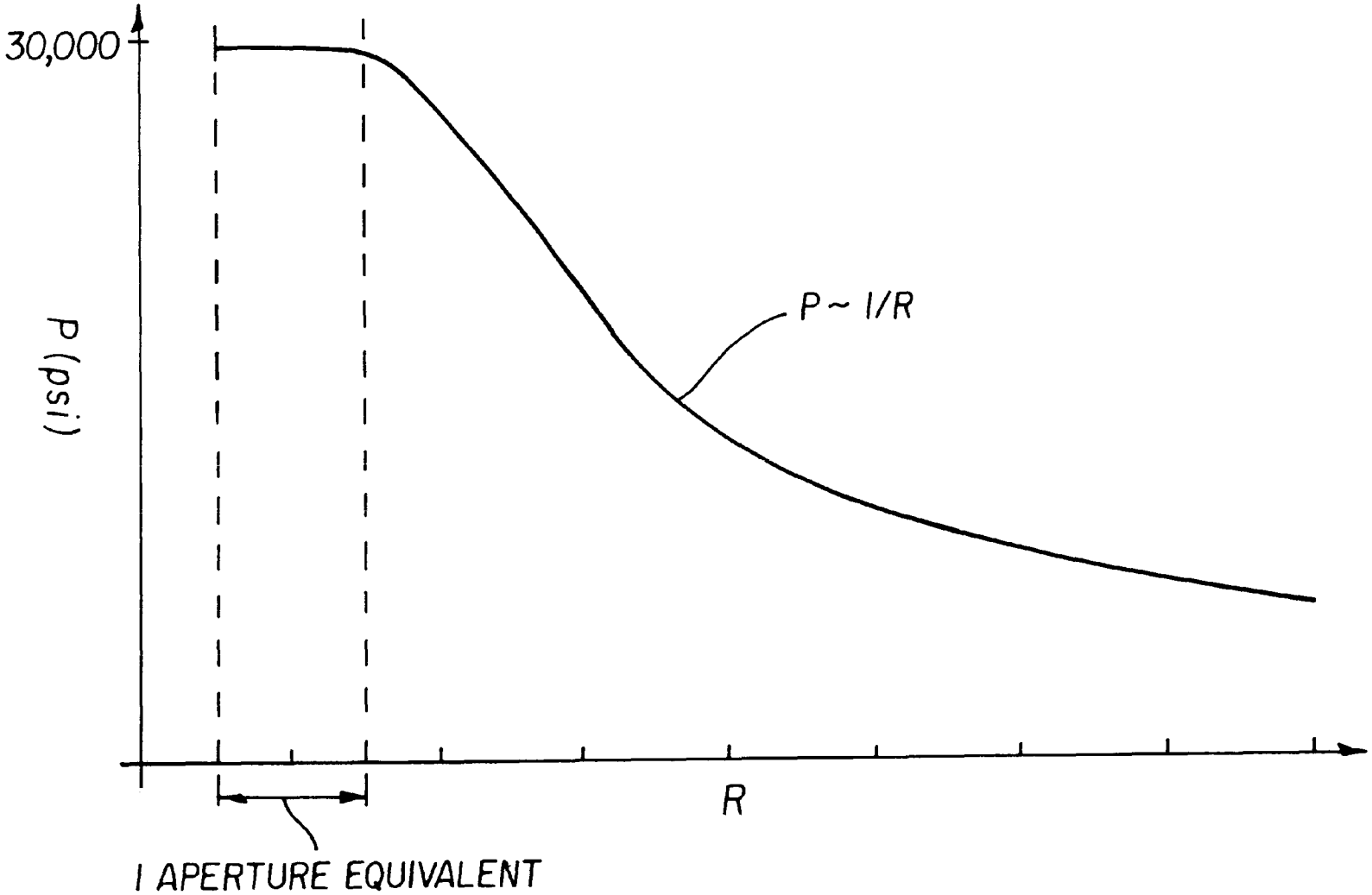
FIG. 6 is a graph illustrating a planar pressure wave generated by firing an array of firing tubes of the type incorporated in the apparatus illustrated in FIG. 2.

The projection of a high pressure shock wave to a fair distance, for example ten meters or more, is obtained by timing the operation of the firing tubes of the arrays to fire in an overlapping manner, thereby generating a plurality of overlapping pressure pulses in a desired propagation direction. For example, placing all tube openings in a plane and firing them simultaneously will generate a planar shock wave traveling perpendicular to the plane. In the near field, including distances up to the equivalent array aperture, the pressure is nearly constant and does not exceed the peak pressure inside a single tube. In the far field, the pressure drops off inversely with distance as shown in FIG. 6, which illustrates the use of 128 firing tubes arranged in an 8×16 array on a 1×2 meter plane, with each firing tube including a 5 cm inside diameter and being fired simultaneously to generate a 30 kpsi, 400 microsecond pulse. As shown in FIG. 6, the pressure achieved is a function of distance (note one aperture corresponds to about two meters). At ten meters the pressure is 10 kspi and lasts about 400 microseconds, which is sufficient to that needed to neutralize mines and remove obstacles.

Figure 7:
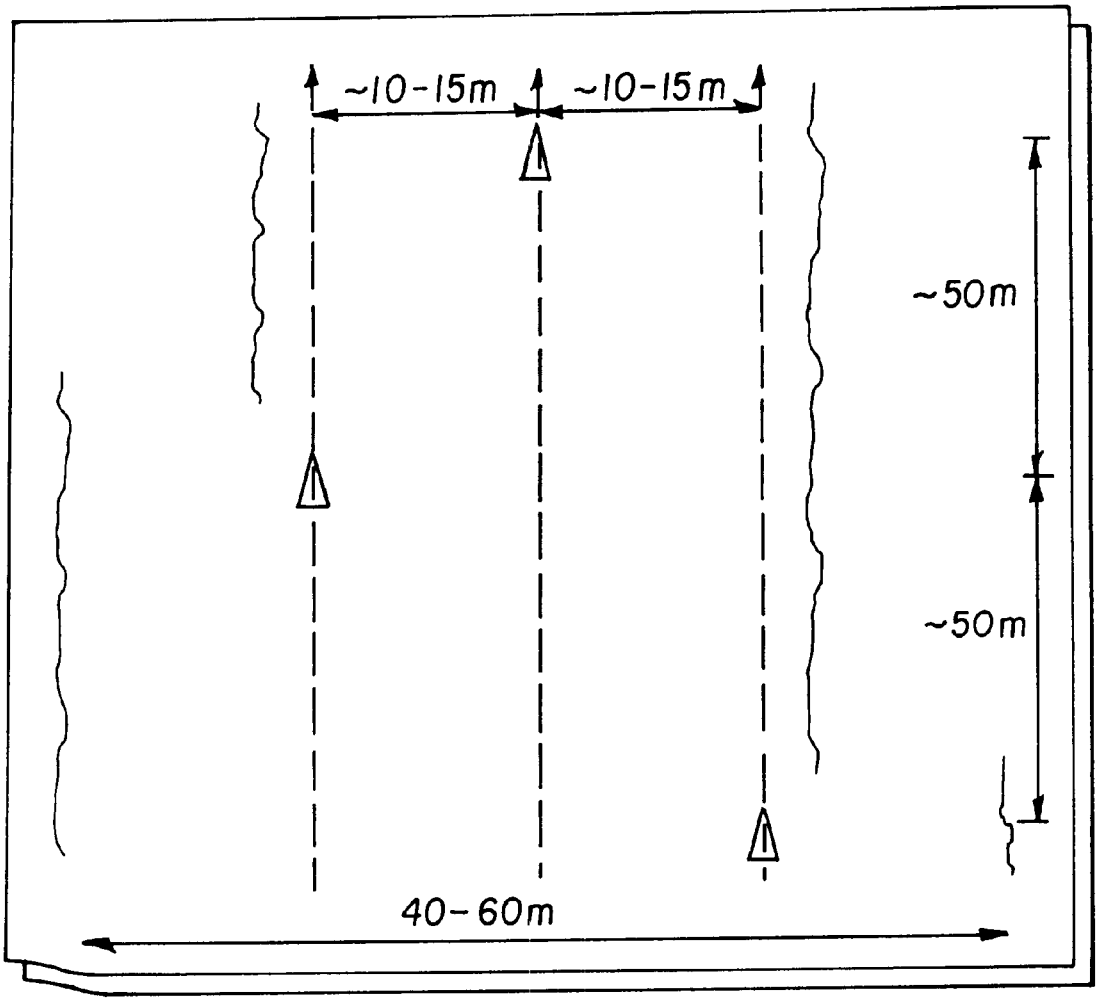
FIG. 7 illustrates the deployment of a plurality of vehicles of the type illustrated in FIG. 2 to clear a path through a surf area.

FIG. 7 illustrates the deployment of a plurality of vehicles to clear a 40–60 meter path through a surf area. The vehicles are separated by lateral distances of 10–15 meters and are separately advanced at intervals of approximately 50 meters. The vehicles can be positioned at initial points in the surf area by a number of methods including both air drops and sea drops. The vehicles settle to the bottom of the surf area on their sled-like bases, and then are activated to move toward the beach adjacent to the surf area.

Figure 8:
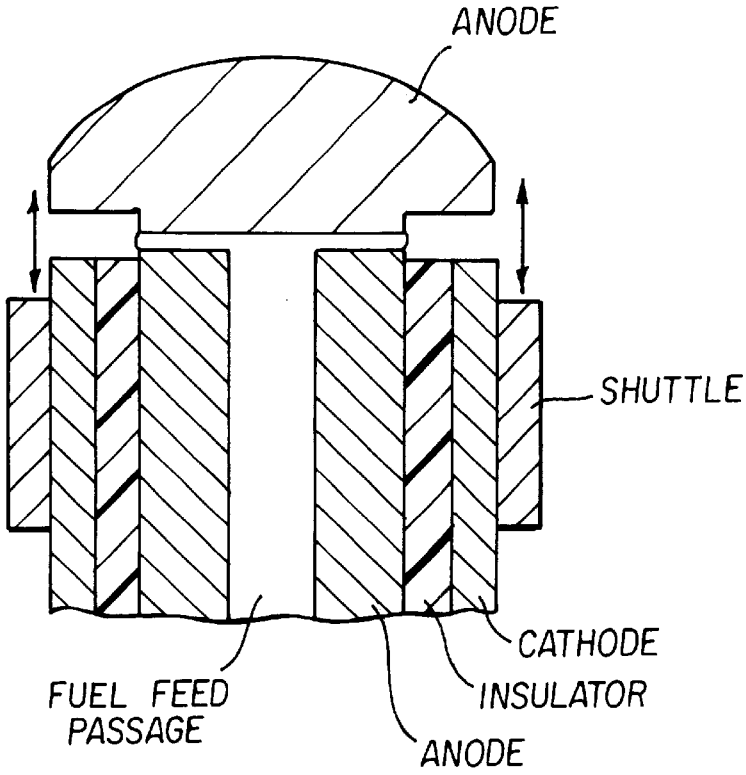
FIG. 8 is a cross-sectional view of a firing tube in accordance with a preferred embodiment of the invention.
Figure 9:
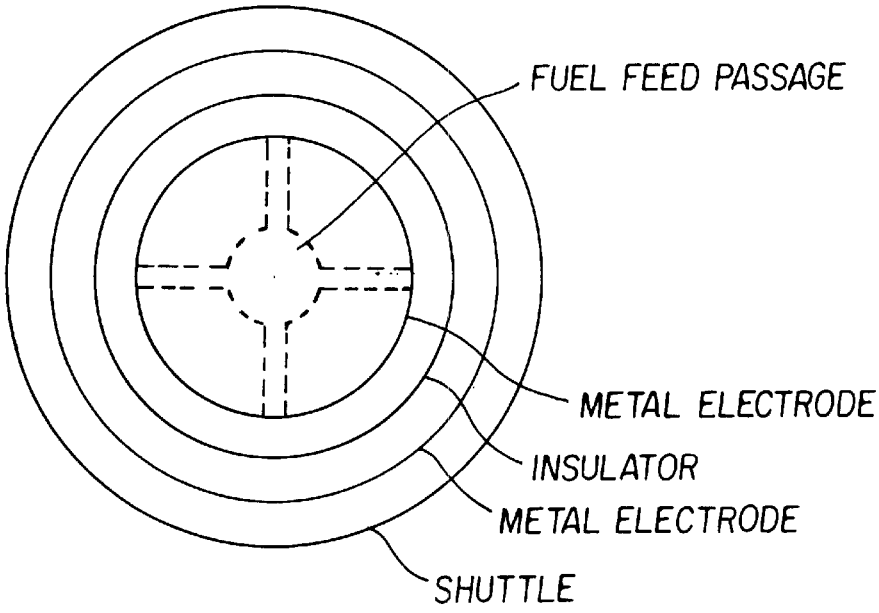
FIG. 9 is a corresponding side view of the firing tube illustrated in FIG. 8.

The firing tubes are preferably have apertures of 5 cm and are arranged in 1×2 meter arrays, although other tube configurations and array configurations are possible depending on the particular application. In a preferred embodiment illustrated in FIGS. 8 and 9, fuel is fed through a fuel feed passage located in an anode of an ignitor incorporated within the structure of the firing tube. An insulation layer is provided between the anode and the cathode of the ignitor. A movable shuttle mechanism, operating as the check valve, slides over the cathode to block the fuel feed passage.

Figure 11:
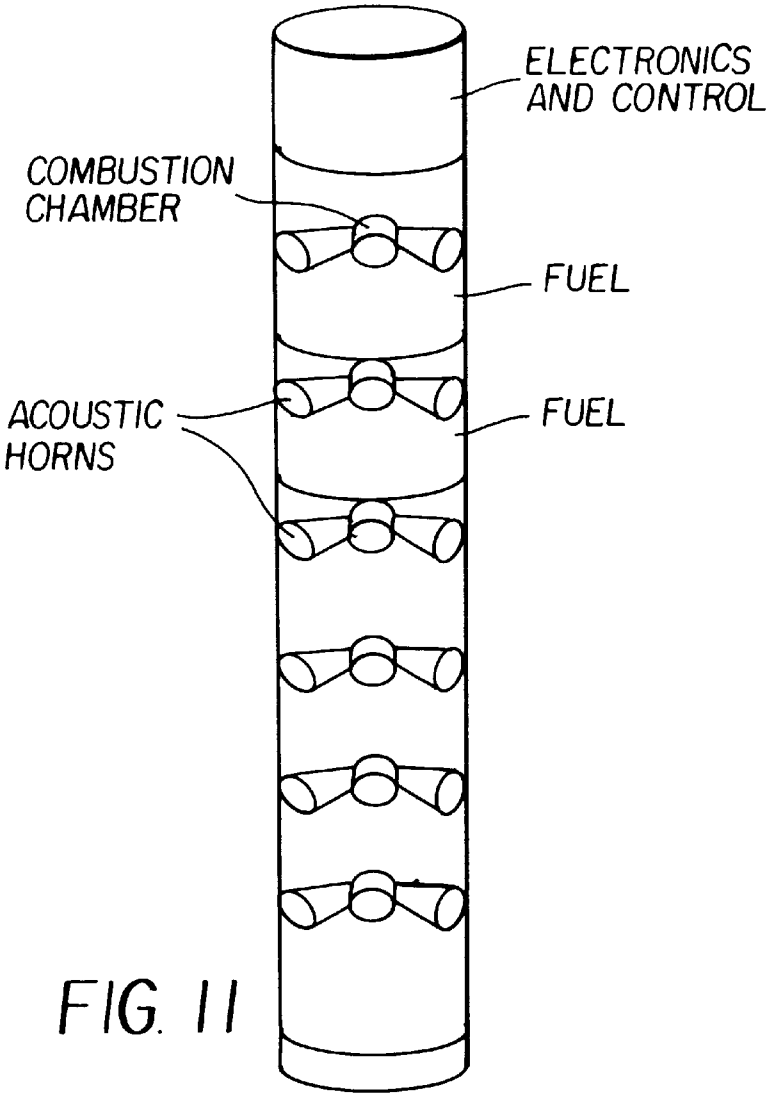
FIG. 11 illustrates the incorporation of the firing tubes of the invention in the main body of a sonar buoy.
Figure 10:
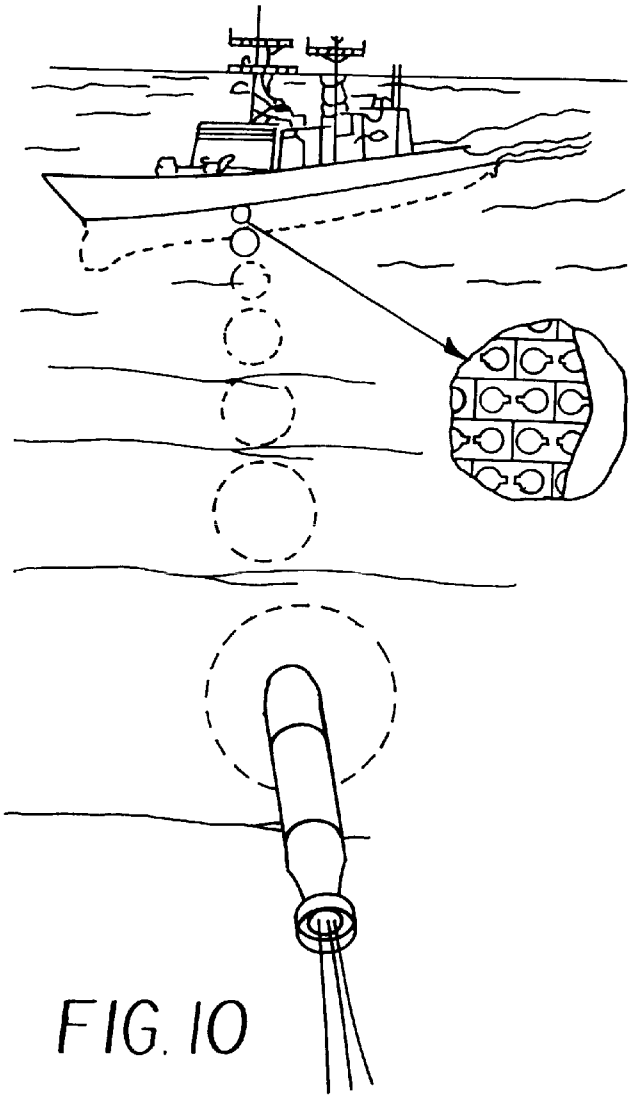
FIG. 10 illustrates the incorporation of the firing tubes of the invention in the main body of a ship.

The invention has been described with reference to certain preferred embodiments thereof. It will be understood, however, that modifications and variations are possible within the scope of the appended claims. For example, the use of the firing tubes is not limited to mine detonation, but instead, can be utilized to perform a variety of other tasks. FIG. 10, for example, illustrates the incorporation of an array of firing tubes on a main body of a ship. Pressure waves generated from the array are utilized to detonate incoming torpedoes threatening the ship. Still further, the firing tubes can be utilized to generate sonar waves. FIG. 11 illustrates a sonar buoy including a plurality of firing tubes that include a plurality of acoustic horns coupled to a common combustion chamber. Fuel for each of the firing tubes is located in adjacent fuel compartments. Still further, other forms of aluminum rather than powder may be employed as fuel for the firing tubes. For example, aluminum pellets or wire can be fed into the combustion chamber under control of a feeding mechanism. In the case of aluminum wire, the wire can be threaded from a spool into the combustion chamber through a wire inlet passage.

What is claimed is:

1. An apparatus for generating underwater pressure waves, comprising:

a firing tube having a combustion chamber that is adapted to be submerged to allow water to enter the combustion chamber through the firing tube;

means for supplying an aluminum fuel to said combustion chamber; and means for igniting the aluminum fuel within said combustion chamber, wherein the aluminum fuel mixes with the water in the combustion chamber before igniting the aluminum fuel, and wherein the aluminum fuel and water burn instead of exploding when the aluminum fuel is ignited to generate prolonged pulses of pressure through the firing tube.

2. An apparatus for generating underwater pressure waves, comprising:

a main body;

a plurality of firing tubes located within said main body, wherein each of said firing tubes has a combustion chamber that is adapted to be submerged to allow water to enter the combustion chamber through the firing tube;

means for supplying an aluminum fuel to at least one of the combustion chambers; and means for igniting the aluminum fuel within the one combustion chamber, wherein the aluminum fuel mixes with the water in the combustion chamber before igniting the aluminum fuel, and wherein the aluminum fuel and water burn instead of exploding when the aluminum fuel is ignited to generate prolonged pulses of pressure through the firing tube.

3. An apparatus as claimed in claim 2, wherein said plurality of firing tubes are arranged in an array on at least one side of said main body.

4. A method of generating underwater pressure waves, comprising the steps of:

submerging a main body having at least one firing tube with a combustion chamber to allow water to enter the combustion chamber through the firing tube in a body of water;

supplying an aluminum fuel to the combustion chamber; and igniting the aluminum fuel in the combustion chambers in the presence of water, wherein the aluminum fuel mixes with the water in the combustion chamber before igniting the aluminum fuel, and wherein the aluminum fuel and water burn instead of exploding when the aluminum fuel ignited to generate prolonged pulses of pressure through the firing tube.

* * * * *